United States Patent [19]

Stephansen

[11] Patent Number: 4,514,913

[45] Date of Patent: May 7, 1985

[54] APPARATUS FOR DRYING A MOVING WEB HAVING MOVABLE DRYER MODULES

[75] Inventor: Erik W. Stephansen, Hillsborough, Calif.

[73] Assignee: Impact Systems, Inc., San Jose, Calif.

[21] Appl. No.: 577,898

[22] Filed: Feb. 7, 1984

[51] Int. Cl.[3] ..... F26B 23/04

[52] U.S. Cl. ..... 34/48; 34/4; 34/41

[58] Field of Search ..... 34/4, 41, 48, 222, 229

[56] References Cited

U.S. PATENT DOCUMENTS 4,202,112 5/1980 von der Eltz ..... 34/4

4,408,400 10/1983 Colapinto ..... 34/4

*Primary Examiner*—Larry I. Schwartz

*Attorney, Agent, or Firm*—Flehr, Hohbach, Test, Albritton & Herbert

[57] ABSTRACT

A cross-direction web dryer includes an elongated frame arranged transversely across a web of moving paper. The support structure carries a plurality of movable dryer modules which are relocatable over the worst moisture streaks occurring in a moving web. In addition, a technique is provided for cooling the movable dryer modules, as well as supplying them with needed electrical heating power and control cables.

8 Claims, 12 Drawing Figures

APPARATUS FOR DRYING A MOVING WEB HAVING MOVABLE DRYER MODULES

The present invention relates to apparatus for drying a moving web having movable dryer modules and more particularly to movable radiant heaters located in the cross-direction of the moving web which may be individually moved and controlled to provide an even moisture profile in the web.

As discussed in a co-pending application assigned to the present assignee, entitled CROSS-DIRECTION WEB DRYER, filed July 6, 1982, in the names of Kenneth Ostrow et al, Serial No. 395,864, and now abandoned, in the paper making process where a continuously moving sheet of paper is produced, it has been known that the drying, which is normally accomplished by cylindrical steam drums, is uneven from edge to edge. In other words, streaks occur. This results in an output of uneven quality. The above co-pending Ostrow application discloses the benefits of efficient correction of variation of moisture content across the web of paper and a control system for effectively accomplishing this objective. More specifically, dryer modules are mounted contiguously side-by-side on a frame across the web of paper and the control system, in response to a cross-direction moisture profile, controls the power applied to individual dryer modules to produce an even or substantially level moisture profile of the moving web.

In another co-pending application, assigned to the present assignee, entitled APPARATUS FOR DRYING A MOVING WEB, filed Mar. 14, 1983, in the names of Erik Stephansen et al, there is disclosed the mechanical details of a cross-direction web dryer which includes the pivotal mounting on two end supports of cantilevered dryer modules which are in a side-by-side relationship across the web and which can be rotated away from the moving web when desired. Also, a cooling air arrangement is disclosed where the main structural support serves as an air plenum for the individual dryer modules.

In providing an effective dryer unit, the cost of the unit, its flexibility and its power requirements are all of great significance.

Thus, it is an object of the present invention to provide an improved apparatus for controlling the moisture profile of a moving web.

In accordance with the invention, apparatus for drying a moving web having a variable cross-direction moisture profile comprises an elongated structural member having a length at least as great as said web in a transverse cross-direction and carrying a plurality of movable dryer modules for drying the web. The modules have an effective heating area and are mounted in close proximity to the web and also mounted for movement in the cross-direction. The combined lengths of the heating areas are substantially less than the overall cross- L direction length of the web. Means are also provided for drying the moisture profile of the web. Automatic means are responsive to this moisture profile to move each dryer module to an optimum cross-direction location where the worst deviations (that is, the locations of moisture streaks) from a predetermined moisture target occurs.

Figure 1:
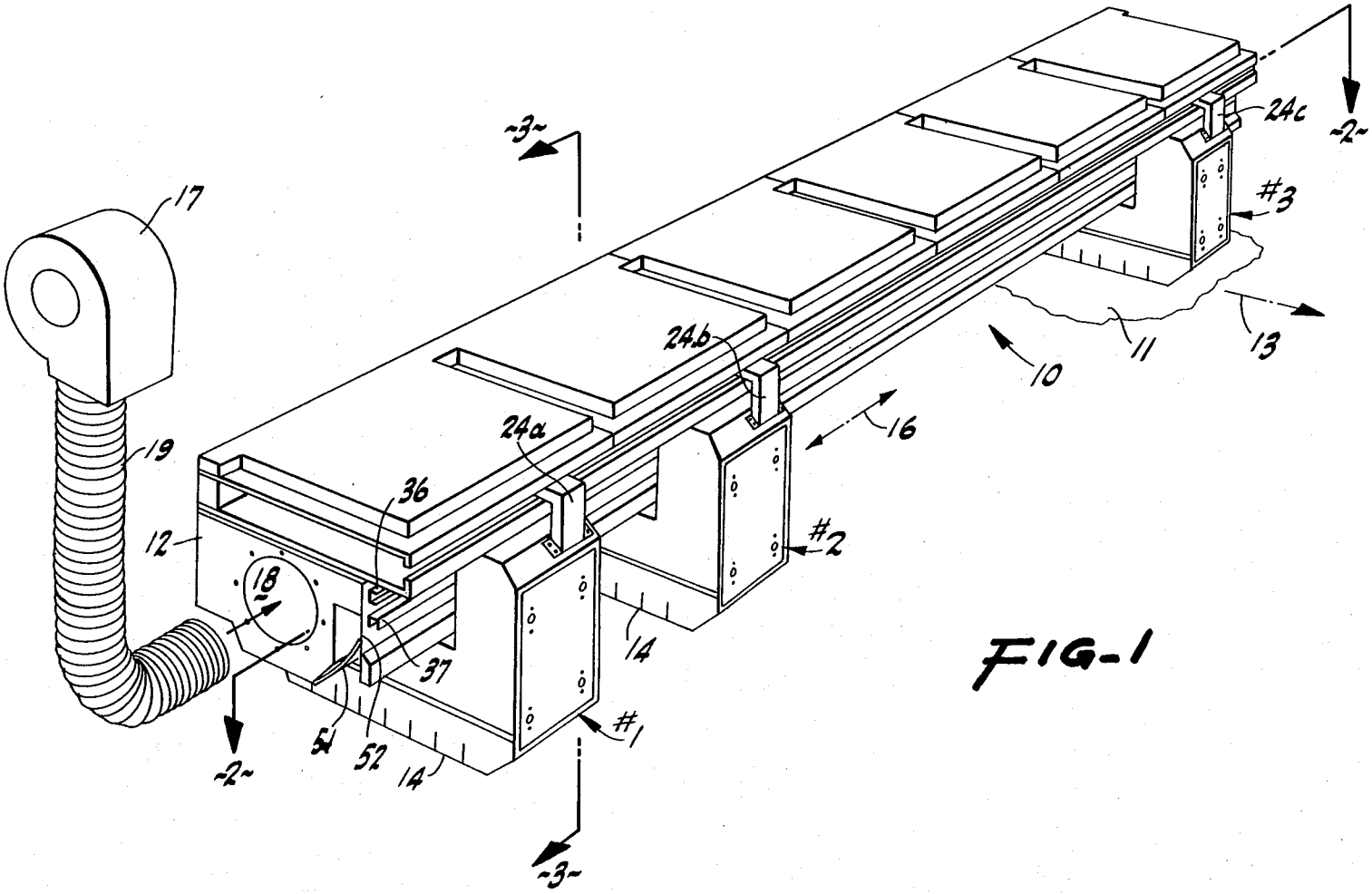
FIG. 1 is a perspective view of apparatus embodying the present invention.

FIG. 1 shows the drying apparatus 10 embodying the present invention which is located transverse of or in the cross-direction to a moving web indicated at 11. The direction of movement of the web is indicated by the arrow 13. Drying apparatus 10 has as its main structural member the elongated member 12 which extends over the moving sheet or web 11. Only a portion of the web and drying apparatus 10 is illustrated in FIG. 1. The main structural member 12 carries on it six movable member dryer modules only three of which are illustrated in FIG. 1; that is, #1, #2 and #3. At the bottom of each module, there is an effective heating area 14 which may be identical to that shown and disclosed in the co-pending Stephansen application. In that application, the heat for the purpose of drying the moisture from the moving sheet or web 11 is provided by a group of quartz heater elements. The dryer modules 1 through 3 are movable in the cross-direction shown by the arrow 16 to any selected location over the moving web 11.

Thus, the modules 1, 2 and 3 are termed RDU's which is an acronym for relocatable dryer units. Each heating area 14 has a length in the cross-direction across the web 11 and as is obvious from inspection of FIG. 1 and is also true of the overall web drying apparatus the sum of the lengths of the effective heating areas is substantially less than the total cross-direction length of the web. The dryer modules and their effective heating areas 14 are mounted in close proximity to web 13; in practice, for example, less than one inch.

Forced air cooling for the individual dryer modules 1, 2 and 3 is provided by forced air blower 17 which is connected to a plenum 18 contained in the structural member 12 by a flexible hose 19.

As disclosed in the co-pending Stephansen et al application, the entire apparatus of FIG. 1 can be mounted across the web 11 at a pair of opposed pivot points and it can be tilted away from the paper for both maintenance purposes and to immediately reduce the application of heat to the web in case of a paper tear or other emergency condition.

Figure 2:
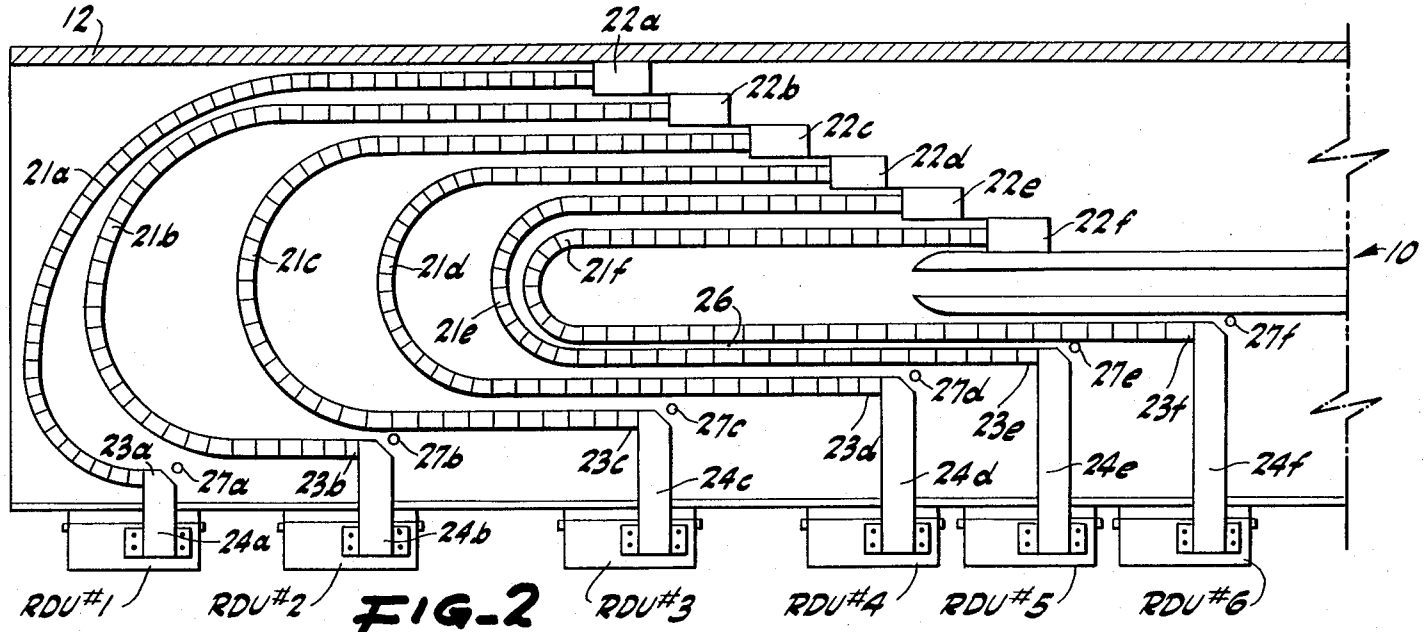
FIG. 2 is a cross-sectional view taken along line 2—2 of FIG. 1.
Figure 3:
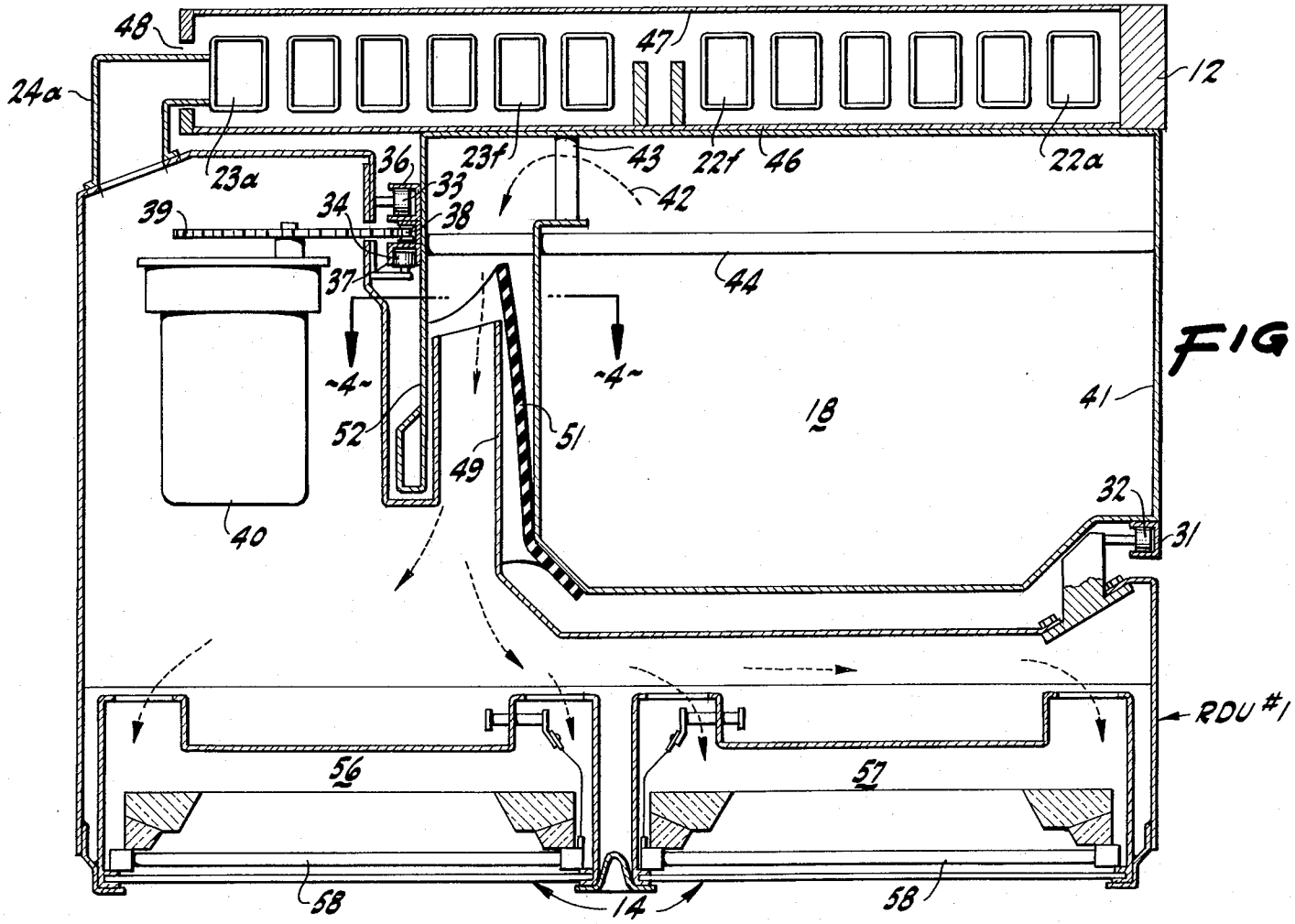
FIG. 3 is a cross-sectional view taken along line 3—3 of FIG. 1.

FIG. 2 illustrates the six RDU's #1–#6 (relocatable dryer units) which would typically be carried by the structural member or frame 12 which extends across the moving web. FIG. 2, of course, illustrates them in a very compressed state. Each RDU is supplied power and control by cables in an associated flexible tube 21*a* through 21*f* which is fixed at its ends 22*a* through 22*f* in order to receive the electrical power conductors and control cables and is movable at its ends 23*a* through 23*f*. These ends are then connected by L-shaped channels or goosenecks 24*a* through 24*f* to the various RDU's. FIG. 1 better illustrates these goosenecks. Flexible tubes 21*a*–21*f*, may be of the type known under the trademark "GORETUBE". The tubes 21 are nested within each other as illustrated and have at least a portion in frictional sliding contact with an adjacent tube; for example, as indicated at the point 26. Furthermore, at their respective ends 23*a*–23*f*, rollers 27*a* through 27*f* are provided to lower the friction between the respective moving parts. This would occur between adjacent tubes during movement of any one or more of the dryer modules or RDU's. FIG. 3 shows a cross-section of the entire structure of FIG. 1 including the dryer module and more particularly how it is mounted for movement on structural member 12. Illustrated is the RDU #1. In general, it is L-shaped and on its bottom is heating surface 14.

Figure 5:
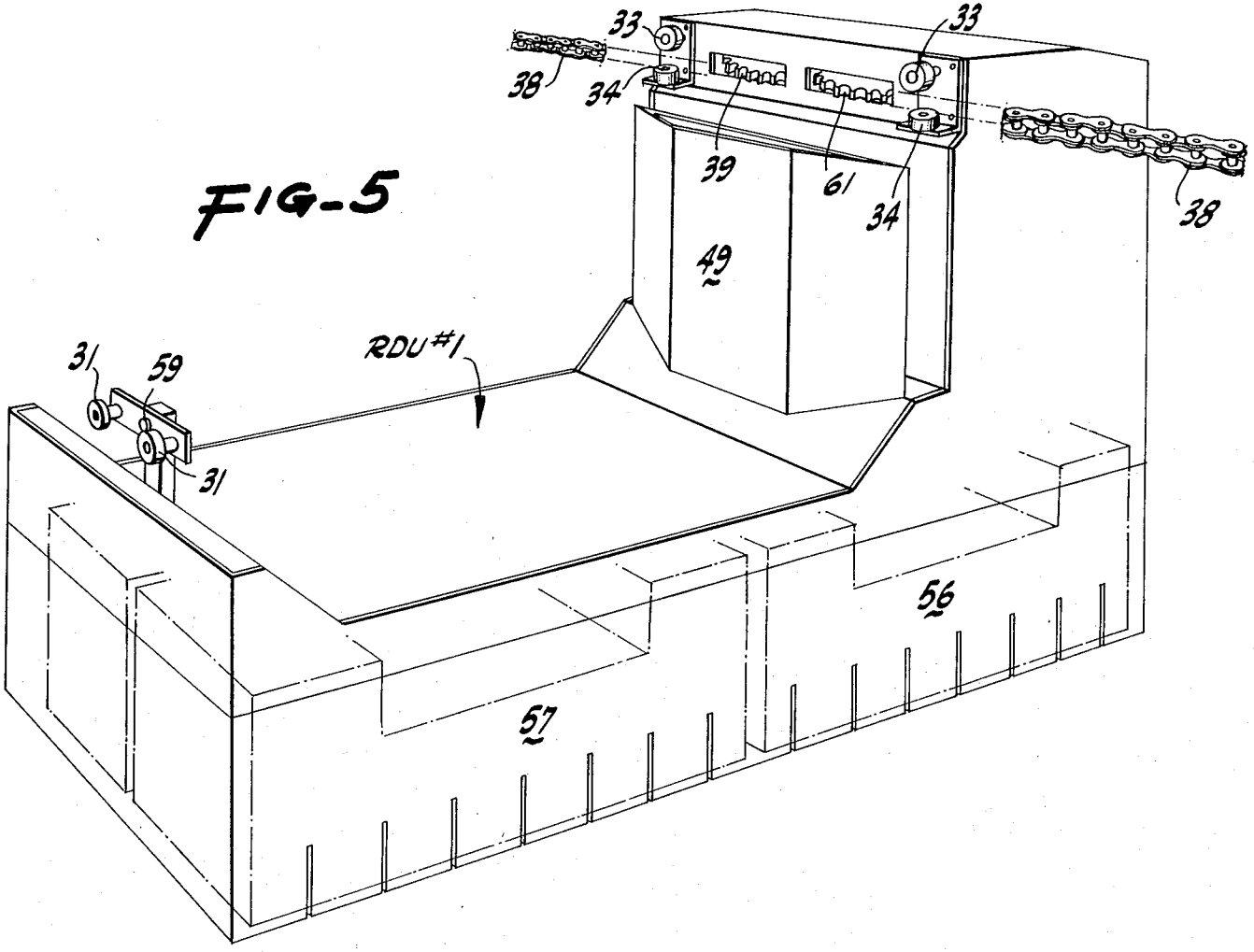
FIG. 5 is a perspective view partially in phantom showing a dryer module as illustrated in FIG. 3 and also in FIG. 1.

On the right side, it is mounted in a channel 31 by means of a pair of rollers 32 (only one is visible) and on its left side in its upper portion a pair of rollers 33 and 34 are mounted for movement in the respective channels 36 and 37 which are mounted at 90° angular orientation from one another. These channels are also shown in FIG. 1. And rollers 33 and 34 are also shown in FIG. 5. Referring again to FIG. 3, fixed between the channels 36 and 37 is a bicycle type chain 38 which meshes with a drive gear 39 which is rotated by a motor 40 to provide the motion for the RDU #1.

In general, structural member 12 is formed of a box-like member 41 which forms the air plenum 18 which supplies cooling air as will be discussed below to the various dryer modules. A gap in the box is left, as shown by the arrow 42, but a rigid box is still provided by the spacer studs 43. In addition, a horizontal rod 44 provides for structural rigidity. At the top portion of the frame or structural member 12, includes a shelf 46 on which lie the flexible conduit tubes 23*a* through 23*f*. This is all enclosed by the cover 47. A gap is left at the end of the cover at 48 to allow space for the goosenecks 24.

To provide cooling air for the various RDU's and their associated heater modules, each RDU includes an air intake tube 49 which interrupts a seal of the plenum 18 which is normally formed by the resilient flap 51. This flap extends from the bottom of the box-like structure 41 to normally abut against the overhanging wall 52 which is an extension of box structure 41. Thus, as shown by the arrows beginning with arrow 42, air flows from the plenum 18 into the dryer module itself.

Figure 4:
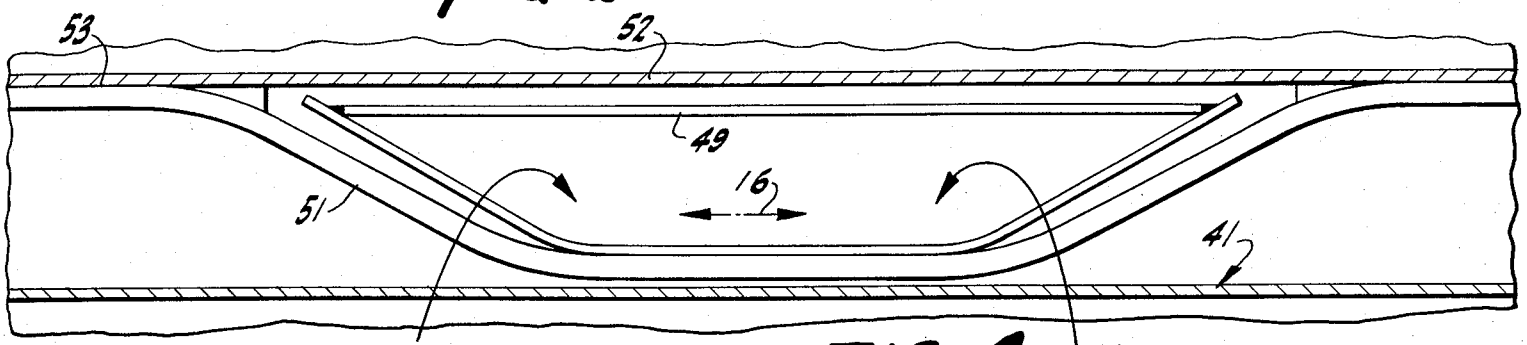
FIG. 4 is a cross-sectional view taken along line 4—4 of FIG. 3.

The interruption of the seal by the air intake 49 is better shown in FIG. 4 which is a cross-sectional view. Here the seal 51 is shown temporarily interrupted by the intake tube 49 as it would move along in the cross-direction illustrated by the double-ended arrow 16. However, along the remainder of the border of the resilient flap 51, a seal is maintained as, for example, shown at 53. Resilient flap 51 should preferably be constructed of silicon rubber, which is resistant to the high ambient heat which would be present. FIG. 1 shows another view of the flap 51 where it is in sealing engagement with the wall 52.

All of the dryer modules #1–#6 include a pair of end-to-end dryer units 56 and 57. These are shown in greater detail in the co-pending Stephansen et al application. As illustrated, however, the units do include the quartz heater elements 58.

FIG. 5 illustrates the dryer module or RDU #1 separated from the frame or structural member 12. The lower rollers 31 are actually a pair of rollers which are pivoted at point 59; and similarly the retaining rollers 33 and 34 include a second pair at the other end of the dryer module. The chain 38 is illustrated which is, of course, affixed to the structural member 12 and which is engaged by the drive gear 39 and also by the encoder gear 61 which indicates the cross-directional position of that particular RDU electronically in order that the unit may be automatically moved and controlled. In other words, this is a feedback signal.

Figure 6:
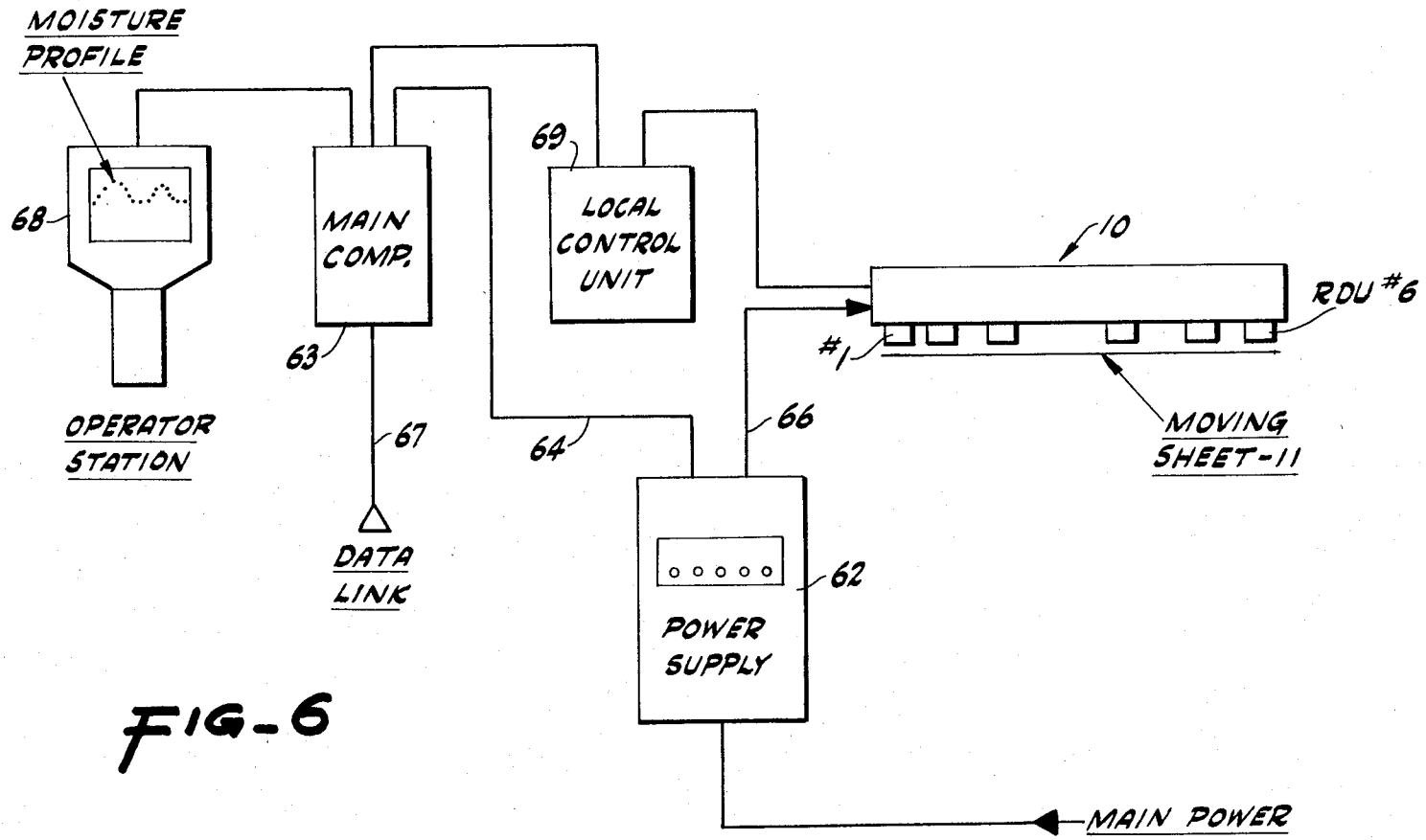
FIG. 6 is a block diagram of an overall drying system including operator panels and associated power supplies embodying the present invention.

FIG. 6 illustrates the major components of the drying system of the present invention including the apparatus 10 itself with the dryer modules or RDU's #1 through #6 which are opposite the moving sheet 11. A power supply unit 62 connected to the main power line receives various set points from main computer 63 via the control line 64 and by the use of individual silicon controlled rectifiers (SCR's) sends the proper amount of power via the line 66 to each relocatable dryer unit 1 through 6. In a preferred embodiment, the heaters are electrically powered to provide infrared heat energy. However, other means of reducing moisture such as microwaves, etc., may be utilized. Power cable 66 would be connected as illustrated in FIG. 2 to the ends 22*a*–22*f* of the flexible power tubes.

Going to main computer 63 is a data link line 67 which is the link between the present system and other existing computer based measurement and control systems which among other things measure moisture at each slice position or zone of a moving sheet and control the average moisture in the sheet by regulating the steam supply (on a paper making machine) to the existing dryer cans. From this data link 67, information as to the cross-direction moisture profile may be obtained and displayed at the operator station 68 as illustrated. Alternatively, entry of such moisture profile may be done manually by the operator through his knowledge of the paper making machine and through analytical techniques either done by the in-house laboratory or by an on-line device which is commercially available and which measures moisture content of various slices. Details of operator station 68 are more fully disclosed in the co-pending Ostrow et al application. Typically, such operator station would be utilized with a web drying apparatus where dryer units are arranged in contiguous side-by-side relationship completely across the moving sheet.

From a system concept, the drying apparatus 10 of the present invention may be used either by itself in a sheet drying system as part of a paper making machine or as a "booster" for use with a drying unit as disclosed in the Ostrow et al application where the dryer units are fixed and arranged in contiguous side-by-side relationship.

Local control unit 69 interfaces with main computer 63 and provides for movement or "shuffling" of the RDU's to their necessary positions for optimal drying of the moisture streaks which are found in the moving sheet 11. The unit 69 could optionally include operator controls for manually shifting the RDU's where necessary. But, in practice, the movable units are automatically shifted to points of maximum wetness or moisture above the target level. As will be discussed in greater detail below, all of these values are contained in the operator station 68.

Figure 7:
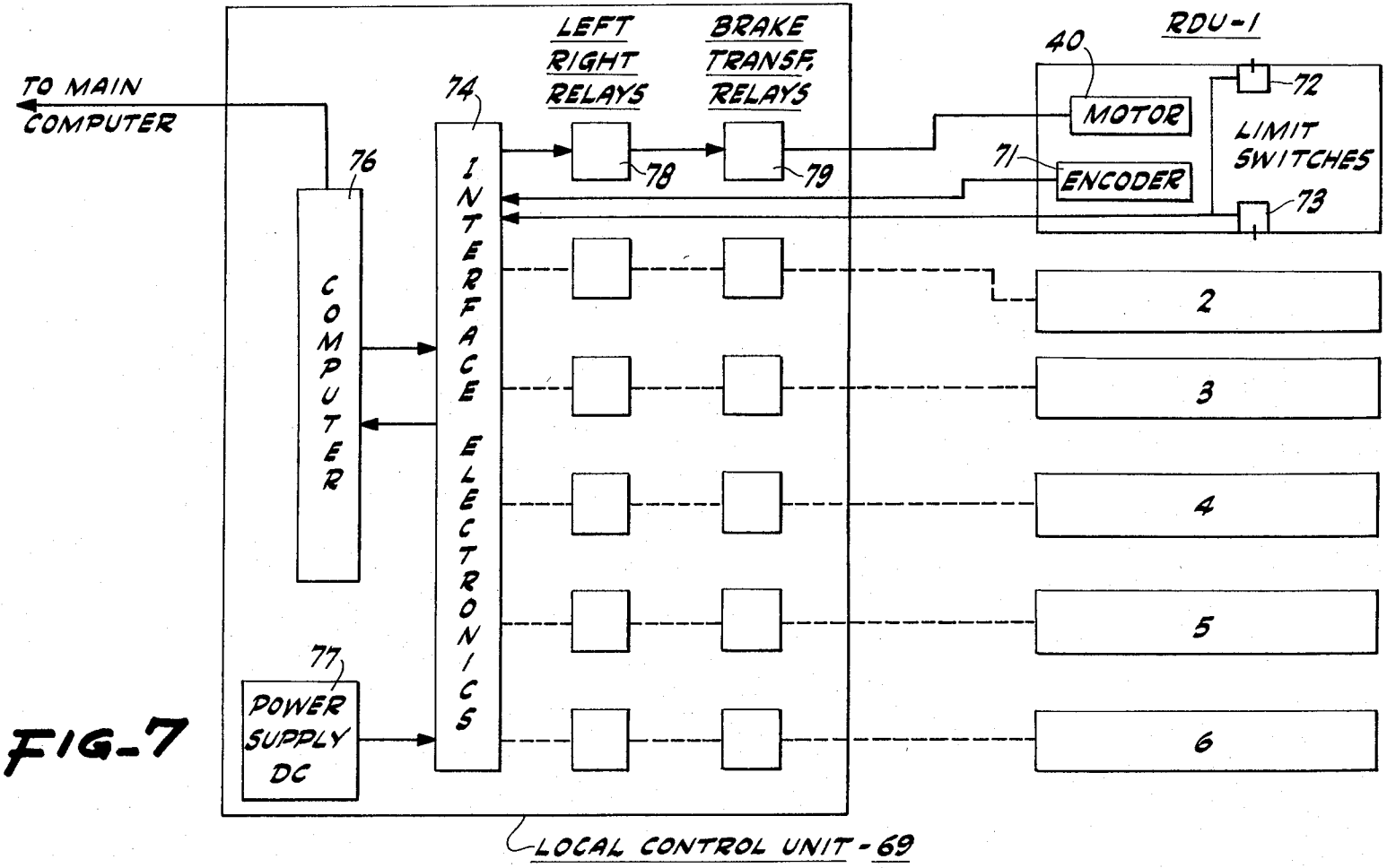
FIG. 7 is a more detailed block diagram of a portion of FIG. 6.

Details of the local control unit are illustrated in FIG. 7 showing how the control unit interfaces with both the drive motor 40 of the RDU's as well as the encoder 71. Encoder 71, referring to FIG. 5, is coupled to the encoder gear 61 to thus indicate the instantaneous cross-direction position of the RDU and is a feedback signal for control purposes. Each RDU also includes left and right limit switches 72 and 73 to prevent accidental collisions.

Both the encoder and limit switch information is coupled to the interface electronics unit 74 which is controlled by a microprocessor type computer 76 coupled to the main computer as indicated. A DC power supply 77 merely supplies control power and a relatively low amount of power for the DC motors 40. In the motor drive system, left-to-right directional relays 78 are provided along with brake transfer relays 79.

The use of a separate feedback system by the use of encoder 71 (as opposed to merely sensing the rotation of motor 40) provides for greater acccuracy.

Figure 8:
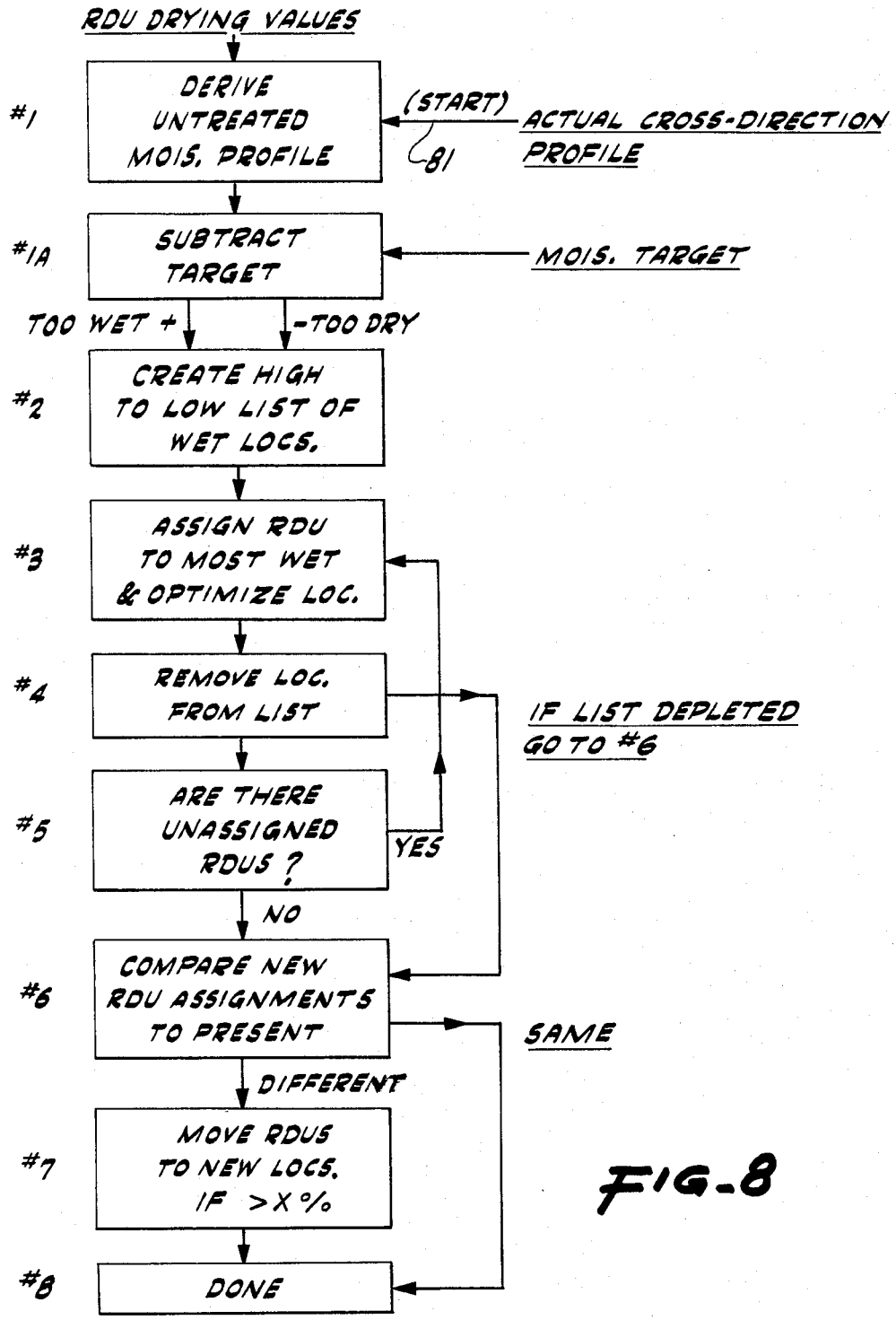
FIG. 8 is a flow chart illustrating the operation of the present invention.

The actual automatic positioning of each dryer module (RDU) to an optimum cross-directional location where the worst deviations from a predetermined moisture target occurs are determined by the algorithm illustrated by the flow chart of FIG. 8. As indicated at the top, it is executed each time an updated cross-direction moisture profile is received as indicated by the start input 81 at step #1. Here the untreated moisture profile is derived; that is, the moisture profile which would exist if no power were currently being applied to the dryer modules. This is easily arrived at as illustrated in the co-pending Ostrow et al application since the power being supplied to a heater depending on the specific paper type is known to remove a predictable amount of moisture from a moving sheet. Thus, by use of the RDU drying values or power being applied to the six dryer modules and the use of the actual cross-directional profile, the untreated moisture profile may be easily derived. In step #1A, the current moisture target (that is, the desired moisture level) is subtracted from each profile value of the untreated moisture profile. Thus, a value will be positive if it exceeds the moisture target or negative if it is too dry.

In step #2, a high-to-low ordered list of the moisture values is created. These would in effect be the moisture values that are "too wet". Thus, in essence, this is a list of the worst deviations from a predetermined moisture target. And in step #3 a theoretical assignment of an RDU to the most wet location is made. However, these are optimized so that the RDU will cover the most wet adjacent moisture streaks. Optimum coverage of adjacent streaks or zones or slices in the moving sheet is accomplished by finding the algebraic sum of the profile values in these streaks and locating the RDU to the maximum of that sum. Such fine level positioning is, of course, also influenced by physical constraints such as conflicts with RDU's already positioned and conflicts with the ends of the supporting frame.

In step #4, removed from this list are all values that are already fully covered by a previously assigned RDU. If there are still unassigned RDU's, as determined by step #5, then another assignment in step #3 takes place. This loop continues until, as indicated in step #4, upon completion or full assignment of the six RDU's, step #6 is sequenced to where the new RDU assignments are compared to the present. If they are of the same, no process changes are required and step #8 "done" is sequenced to. However, if there are different locations, some RDU's are to be moved. However, in order to prevent undue mechanical wear because of frequent movement of the RDU's, no movement will occur unless the deviation of the moisture at the new location is greater than X percent (as determined by the operator) of the deviations of moisture from the target already covered by an assigned RDU. Thus, by the foregoing technique, the RDU's are shifted to their optimum locations.

Figure 9A:
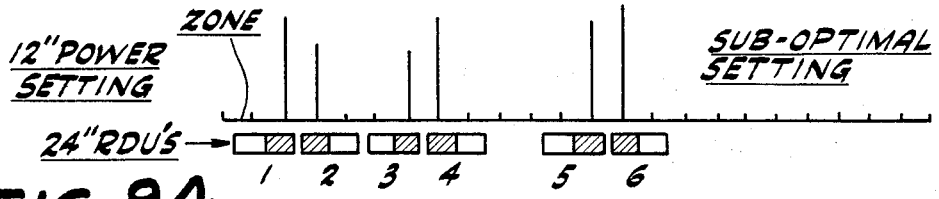
FIGS. 9A and 9B are diagrams illustrating on the optimal positioning of the dryer modules.
Figure 9B:
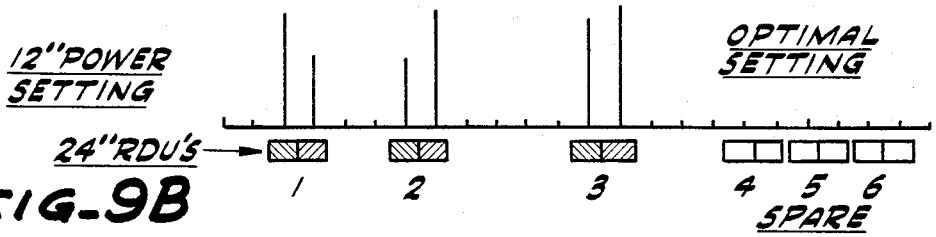

FIGS. 9A and 9B illustrate another optimizing technique which is especially useful where an RDU has a greater coverage than the zones or slices in which the moving web is divided up. For example, in both FIGS. 9A and 9B, the zones are subdivided as indicated and, for example, they might be 12 inches long whereas the RDU's might be 24 inches. Sub-optimal settings are indicated in FIG. 9A where only one-half of, for example, all the dryer modules are used for the six wet streaks. A more optimal setting is illustrated in FIG. 9B where one RDU covers the two adjacent moisture streaks. This may be achieved by summing the algebraic moisture deviation values of adjacent peaks and then by determining the distance of these peaks and the corresponding affected drying area of the RDU and positioning the RDU accordingly.

Figure 10:
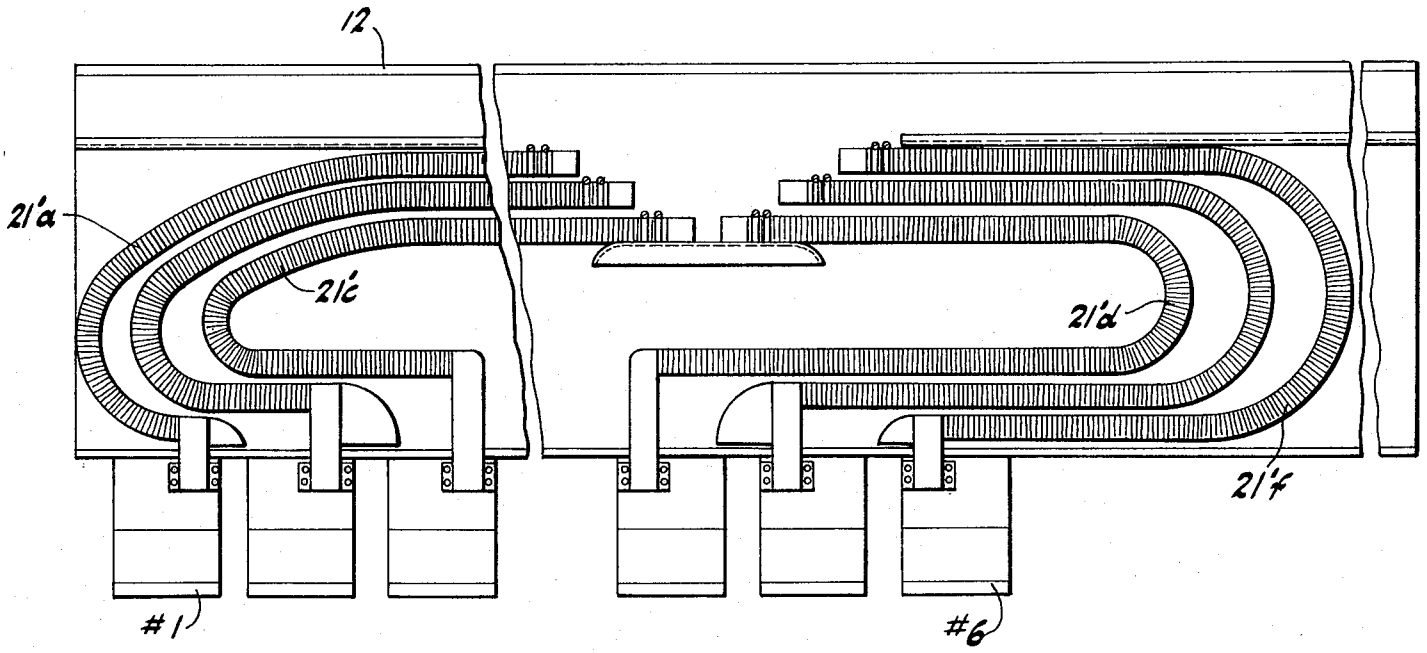
FIG. 10 is a cross-sectional view of an alternate embodiment of FIG. 2.

FIG. 10 illustrates an alternative embodiment of the flexible power carrying tubes 21*a*–21*f* where the cable tray deck has been simplified by flipping over half of the cable carrying conduits and running them from the opposite side; that is, 21'*a* through 21'*c* are from one side and 21'*d* through 21'*f* are from the opposite. This reduces the loads on the flexible tubes when run in the vertical position and also reduces the width of the entire structure simplifying its overall design. Of course, there is some limitation in the extent of movement of the various RDU's but this can be compensated for in the computer control unit.

Figure 11:
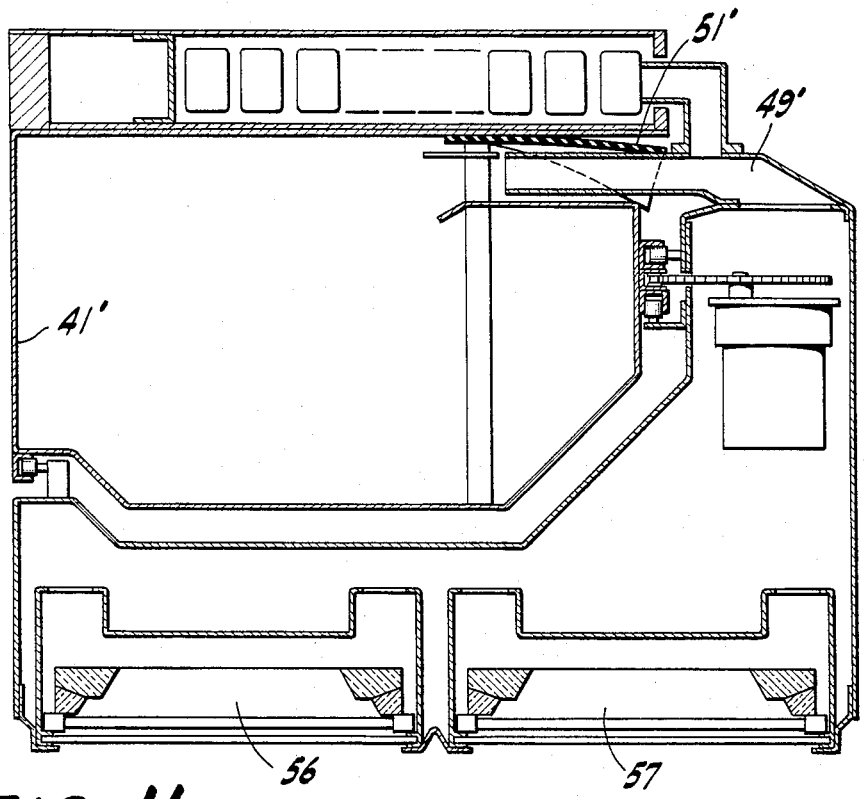
FIG. 11 is a cross-sectional view illustrating an alternate embodiment of FIG. 3.

FIG. 11 which is similar to the cross-section of FIG. 3 illustrates another modification where the air intake tube 49' is now located in a horizontal rather than a vertical orientation along with the resilient flap 51'. This removes the resilient flap 51' from the re-radiation from the moving web improving its life and also simplifies maintenance. In addition, the structural stability of the overall frame is believed to be improved. However, where the flap is made of, for example, silicon rubber which is resistant to heat this may not be a serious problem. Thus, in summary, the movable drying system of the present invention provides for the same effective drying capability as an across-the-web dryer which has contiguous side-by-side units, but at lower cost and with power savings.

What is claimed is:

1. Apparatus for drying a moving web having a variable cross-direction moisture profile comprising:

an elongated structural member having a length at least as great as said web in a transverse cross-direction and carrying a plurality of movable dryer modules for drying said web, said modules having an effecting heating area mounted in close proximity to said web and for movement in said cross-direction, the combined lengths of said heating areas measured in the cross-direction being substantially less than said length of said web measured in the cross-direction;

means for deriving said moisture profile of said web and means for compiling a list of deviations from a predetermined moisture target at a plurality of locations across said web;

automatic means responsive to said moisture profile to move each dryer module to an optimum cross-direction location where the worst deviations of said list from said predetermined moisture target occurs.

2. Apparatus as in claim 1 where said structural member includes an air plenum connected to all of said dryer modules together with forced air cooling means for supplying cooling air to said air plenum and including air scoop means for connecting said air plenum to said dryer modules while said modules are moved in said cross-direction.

3. Apparatus as in claim 2 where said air scoop means includes a resilient flap extending along and sealing said air plenum of said structural member in a cross-direction, each of said movable dryer modules including an air intake tube interrupting said seal of said resilient flap and extending into said air plenum.

4. Apparatus as in claim 3 where said heating areas of said dryer modules cause a re-radiation of heat in a substantially vertical path from the surface of said web and where said resilient flap is mounted out of said re-radiation path.

5. Apparatus as in claim 1 where each of said dryer modules includes electrically powered heating elements and including a plurality flexible tube means each corresponding to a single dryer module for providing a conduit for said electrical power said tubes being nested within each other and having at least a portion in frictional sliding contact with an adjacent tube during movement of said dryer modules.

6. Apparatus as in claim 1 where said moisture profile includes moisture streaks and said automatic means includes means for determining the optimum locations of dryer modules by determining the wettest adjacent moisture streaks and moving a module to that location.

7. Apparatus as in claim 1 where said automatic means includes means responsive to a change in said moisture profile to move at least one of said dryer modules to a new location.

8. Apparatus as in claim 7 where said change in said moisture profile must be greater than a predetermined percent of a previous said worst deviation before said move of a dryer module will occur.

* * * * *